US007210593B2

(12) United States Patent
Stull et al.

(10) Patent No.: US 7,210,593 B2
(45) **Date of Patent: *May 1, 2007**

(54) TAMPER-EVIDENT QUICK TWIST CLOSURE

(75) Inventors: Gene Stull, Far Hills, NJ (US); Robert Auer, East Stroudsburg, PA (US)

(73) Assignee: Stull Technologies, Inc., Somerset, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/519,045

(22) PCT Filed: Jun. 25, 2003

(86) PCT No.: PCT/US03/20264

§ 371 (c)(1),
(2), (4) Date: Dec. 22, 2004

(87) PCT Pub. No.: WO04/000661

PCT Pub. Date: Dec. 31, 2003

(65) Prior Publication Data

US 2005/0242054 A1 Nov. 3, 2005

Related U.S. Application Data

(60) Provisional application No. 60/391,349, filed on Jun. 25, 2002.

(51) Int. Cl.
*B65D 41/47* (2006.01)

(52) U.S. Cl. ..... 215/252; 215/43; 215/321; 215/318; 215/258; 220/780; 220/301

(58) Field of Classification Search ..... 215/43, 215/252, 258, 318, 321; 220/301, 780
See application file for complete search history.

(56) References Cited

U.S. PATENT DOCUMENTS

| | | | |
|---|---|---|---|
| 697,371 | A | 4/1902 | Sindorf |
| 1,615,157 | A | 1/1927 | Baum |
| 2,721,595 | A | 10/1955 | Nichols |
| 3,136,458 | A | 6/1964 | Ruetz |
| 3,252,446 | A | 5/1966 | Bateman |
| 3,372,834 | A | 3/1968 | Ayotte et al. |
| 3,430,798 | A | 3/1969 | Goyet et al. |
| 3,468,447 | A | 9/1969 | Smalley |

(Continued)

*Primary Examiner*—Anthony D. Stashick
*Assistant Examiner*—James Smalley
(74) *Attorney, Agent, or Firm*—Drinker Biddle & Reath LLP

(57) ABSTRACT

A cap with a tamper-evident ring is designed to snap engage a container that is provided with an upper and lower bead. A ring of teeth provided along an inside skirt of the cap engage teeth located along an inside wall of the container. When the cap is snapped onto the container, both sets of teeth automatically engage and a plug seal provided on the cap engages the container upper bead. By turning the cap clockwise or counterclockwise, the side angles of the teeth force the cap to disengage upwards over the upper bead and unsnap from the container. When the closure is opened for the first time, the ring breaks away from the cap and slides down the container below the lower bead, which keeps the ring from coming off the container and provides evidence that the cap had been opened.

26 Claims, 5 Drawing Sheets

U.S. PATENT DOCUMENTS

| | | | |
|---|---|---|---|
| 3,896,959 | A | 7/1975 | Roy |
| 3,910,444 | A | 10/1975 | Foster |
| 3,955,696 | A | 5/1976 | Finke |
| 3,964,605 | A | 6/1976 | Vezirian |
| 3,982,651 | A | 9/1976 | Braun et al. |
| 4,171,057 | A | 10/1979 | Gach |
| 4,511,050 | A | 4/1985 | Nicol |
| 5,384,096 | A | 1/1995 | Burns |
| 5,458,854 | A | 10/1995 | Burns |
| 5,529,202 | A | 6/1996 | Shamis |
| 5,927,531 | A | 7/1999 | Kuzma et al. |
| 5,944,208 | A | 8/1999 | Gale |
| 6,068,421 | A | 5/2000 | Pierpont |
| 6,330,959 | B1 | 12/2001 | Dark |
| 6,394,295 | B2 | 5/2002 | Claude |
| 6,426,049 | B1 | 7/2002 | Rosen et al. |
| 2001/0030196 | A1 | 10/2001 | Stull et al. |

TAMPER-EVIDENT QUICK TWIST CLOSURE

This application claims priority from U.S. Provisional Application 60/391,349 filed Jun. 25, 2002, which is incorporated herein by reference.

FIELD OF THE INVENTION

The present invention is directed to closures in general, and more particularly to a one-piece injection molded cap having a tamper-evident breakaway bottom ring. After initial removal of the cap and separation of the breakaway ring, the cap can be snapped back onto the container for resealing contents contained therein.

BACKGROUND OF THE INVENTION

A twist closure for a container, such as a cap for a soft drink bottle having a threaded neck portion, is typically provided with a top portion and an elongated skirt portion downwardly depending therefrom that circumscribes the outer periphery of a threaded container neck. Removing the closure from the container is conventionally accomplished by rotating the closure along the threaded neck in the counterclockwise direction, while securing the closure onto the container is conventionally accomplished by rotating the closure along the threaded neck in the clockwise direction. The threading on the container neck usually restricts the rotating direction of the closure to one direction for removal and one direction for attachment. This unidirectional movement is somewhat limiting and can be inconvenient at times. In addition, the conventional, elongated skirt portion tends to prolong the process of attaching and removing closures from containers.

Recognizing some of the limitations of prior art twist closures, the present inventors have designed a closure that is economical to manufacture, requires less material, is simple and easy to manipulate and is further provided with a tamper-evident feature that depends from an abbreviated skirt portion. The inventive closure interacts with a container neck that enables attachment of such closure by a downward pressing of such closure onto the container neck, yet enables removal from the container neck by a shortened rotation of such closure in either the clockwise or counterclockwise direction.

SUMMARY OF THE INVENTION

A one-piece injection molded closure comprises a cap with a tamper-evident ring that is designed to snap engage a specialized container neck. The container is provided with an upper bead around the container lip and a lower bead located further down on the side of the neck. Inside the cap is a continuous ring of teeth that engage teeth located inside the container neck wall. When the cap is snapped onto the container neck, both sets of corresponding teeth are automatically engaged and a plug seal provided on the closure engages the container upper bead. By turning the cap clockwise or counter-clockwise, the side angles of the teeth force the cap to disengage upwards, causing it to ride up over the upper bead and unsnap from the container neck.

The cap and tamper-evident ring are initially joined by a plurality of tapered posts extending along the side skirt, which creates open skirt areas that save material and reduce the overall production part cost. The cap is initially seated on the upper bead of the container neck, while the tamper-evident ring is initially seated on the lower bead. When the closure is opened for the first time, the tapered posts break away along a top surface of the ring, causing the ring to separate from the cap and slide down the container neck below the lower bead, which bead keeps the ring from coming off the container neck. The bottom ring being broken indicates the cap had been opened.

The upper bead of the container, which assumes an annular ring configuration, is engaged by a complementary annular ring under the skirt of the cap. The closure further contains a plug seal to retain it firmly against the container neck. The turning of the cap relative to the container neck insures that the annular ring under the skirt of the cap unsnaps from the upper bead or lip of the container before the teeth are totally disengaged.

The one-piece closure of the present invention was developed to reduce material, production time and basic assembly cost, making it more desirable to manufacture when compared to other caps. An efficient thin cap design makes the inventive closure extremely attractive to produce. Because such design eliminates typical threads found on most containers and interior cap side walls, the cap can be pushed directly down onto the container, which eliminates the time and assembly equipment associated with threaded caps. The angles provided on both sides of the engaging and disengaging teeth that are located around the top inside skirt of the cap enable the cap to be automatically self centering left or right when the cap is assembled to the top of the container.

This design also provides a consumer with a fast, efficient and easy way to remove the cap without unthreading, squeezing or pulling. When the consumer twist's the cap left or right, the teeth become small cams and eject the cap from the container, causing the upper bead to unsnap and the cap to open. The cap is simple and easy to open but still requires a deliberate left or right turning action, which virtually eliminates the possibility of an accidental opening.

DETAILED DESCRIPTION OF THE INVENTION

Figure 1:
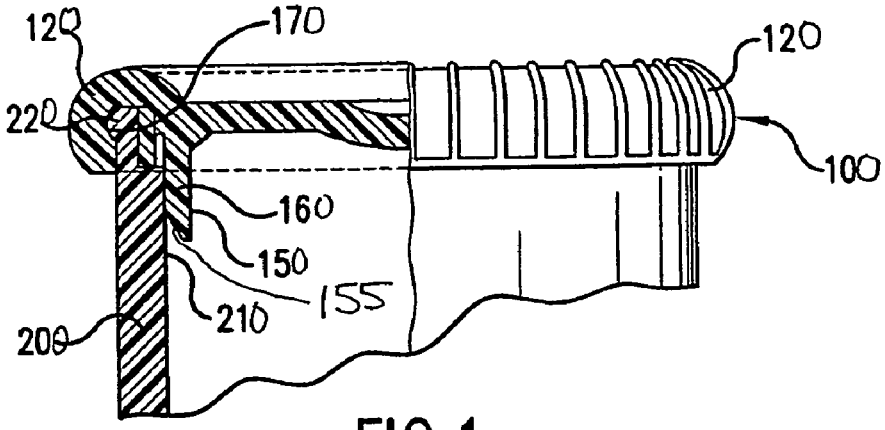
FIG. 1 is a partial cross-sectional and partial perspective view of one embodiment a closure cap secured to a container of the present invention and shown without a tamper-evident ring for purposes of illustration.
Figure 2:
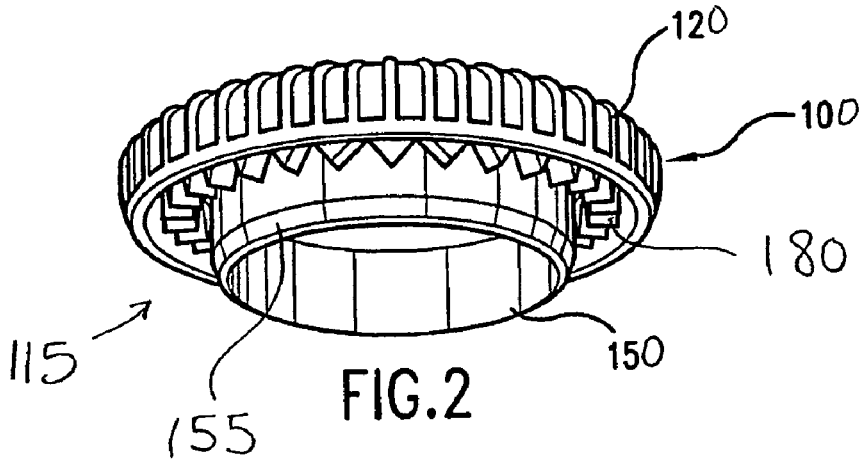
FIG. 2 is a bottom perspective view of the closure cap of FIG. 1.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIGS. 1–8B illustrate one embodiment of the closure of the present invention with the tamper-evident ring 300 separated from the cap 100 to illustrate aspects of the cap 100 that enable engagement and disengagement of the cap 100 with a container 200, while FIGS. 9–14 illustrate a container 200 and a cap 100 with the tamper-evident ring 300 attached thereto.

Figure 3:
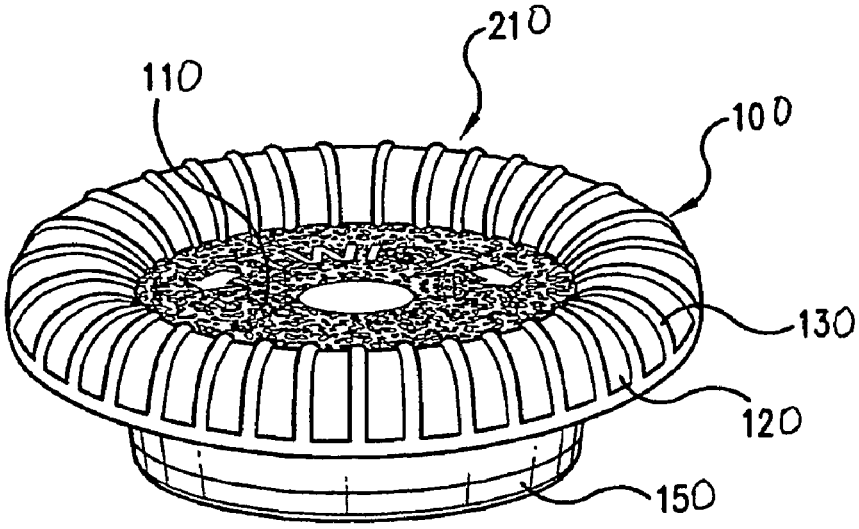
FIG. 3 is a top perspective view of the closure cap of FIG. 1.
Figure 4:
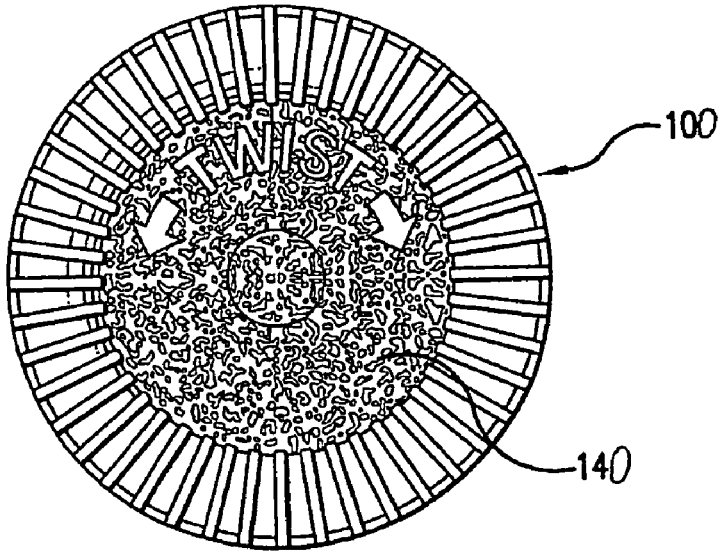
FIG. 4 is a plan view of the closure cap of FIG. 1.

Cap 100, which is preferably injection molded as a single piece, has an outer pressing surface 110, an inner sealing area 115 (FIG. 2) and a side skirt 120 depending downwardly from said outer pressing surface 110. Skirt 120 may be provided with a tactile gripping surface with raised ridges 130 to help a consumer facilitate the twisting of the cap 100 in either the clockwise or counterclockwise direction as explained herein. Such raised edges 130 may extend along the entirety of the side skirt 120 and onto the top 110 of the cap 100 as shown in FIG. 3. The central portion 140 of the top 110 of the cap 100 may be textured or scuffed so that graphics or twist direction indication (FIG. 4) or any other message or design may be easily imprinted thereon by means known in the art.

Figure 11:
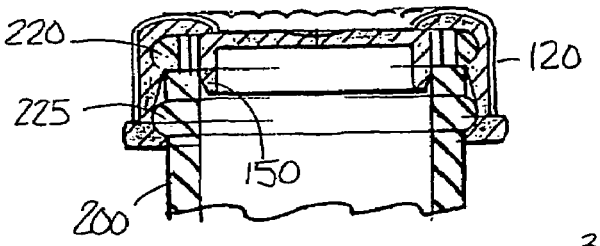
FIG. 11 is a cross-sectional view taken through a diameter of the cap, tamper-evident ring and container of FIG. 9.
Figure 9:
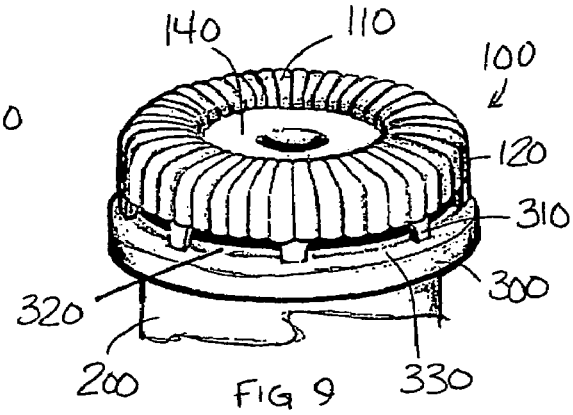
FIG. 9 is a perspective view of the closure cap of the present invention with a tamper-evident ring attached thereto.
Figure 10:
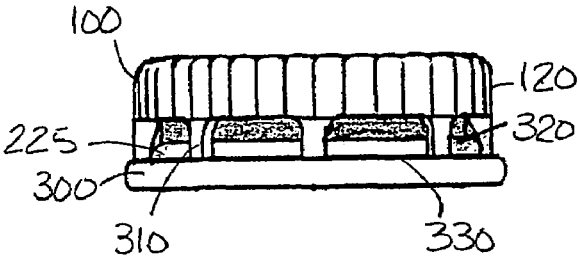
FIG. 10 is a side elevational view of the cap and ring of FIG. 9.
Figure 13:
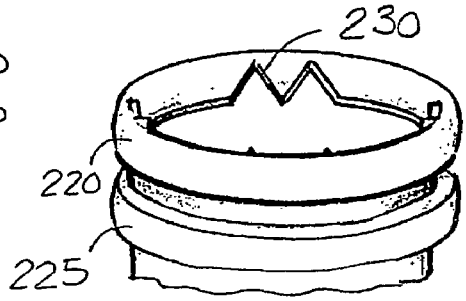
FIG. 13 is a perspective view of one embodiment of the container of FIG. 9.
Figure 12:
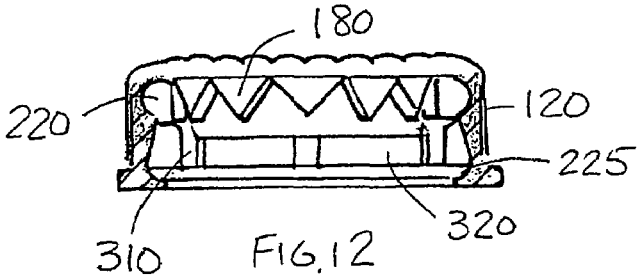
FIG. 12 is a cross-sectional view taken through a diameter of just the cap and tamper-evident ring of FIG. 9.

Cap 100 is further initially provided with a tamper-evident ring 300 that is designed to snap engage a container neck provided with an upper bead or lip 220 and a lower bead 225 spaced from said upper bead or lip 220 (FIG. 13). The cap 100 and tamper-evident ring 300 are initially joined by a plurality of tapered posts 310 extending along the side skirt 120, which create open skirt areas 320 that save material and reduce the overall production part cost. The cap 100 is initially seated on the upper bead 220 of the container neck, while the tamper-evident ring 300 is initially seated on the lower bead 225 as shown in FIGS. 10–12. The lower bead 225 is made slightly larger than the cap diameter intentionally for the assembly process, such that during the assembly, direct down pressure is applied to the circumference of the tamper-evident ring 300 and to the top section 110 of the cap 100, which insures that the tamper-evident ring 300 does not separate from the cap 100 during assembly.

Securing of the cap 100 to the container 200 is further facilitated by an annular ring 170 located on the inside of the side skirt of the outer ring 120 surrounding and locking into position the upper bead or lip 220 of the container 200. When the cap 100 is removed from the container 200 for the first time by rotating the cap 100 relative to the tamper-evident ring 300 and lower bead 225, the tapered posts 310 break away along a top surface 330 (FIGS. 9, 10) of the ring 300, causing the ring 300 to separate from the cap 100 and slide down the container neck below the lower bead 225 (FIG. 14), which bead 225 keeps the ring 300 from coming off the container 200. Alternatively, the tapered posts 310 may break away along the intersection of the posts 310 and the side skirt 120, causing the ring 300 and posts 310 (see dotted posts in FIG. 14) to slide down the container neck below the lower bead 225. The tamper-evident ring 300 being separated from the cap 100 indicates the cap 100 had been opened. It will be appreciated that the cap 100 of the present invention, once it has been initially separated from the tamper-evident ring 300, may be attached to a container 200 having an upper bead 220 and a lower bead 225 as shown in FIGS. 9–14, or only an upper bead 220 as shown for ease of illustration in FIGS. 1–8, it being understood that cap engagement with the lower bead 225 is no longer necessary once the tamper-evident ring 300 has been separated from the cap 100.

Figure 6:
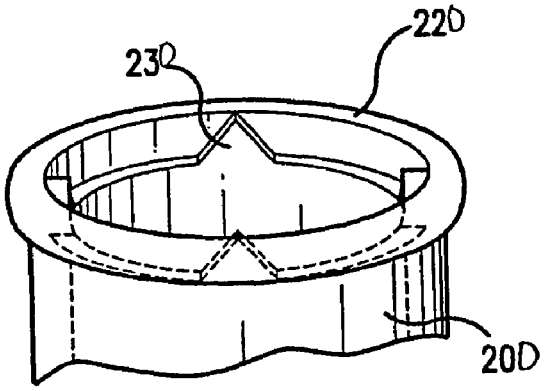
FIG. 6 is a front perspective view of a container neck having ejector teeth along an inner wall.
Figure 7:
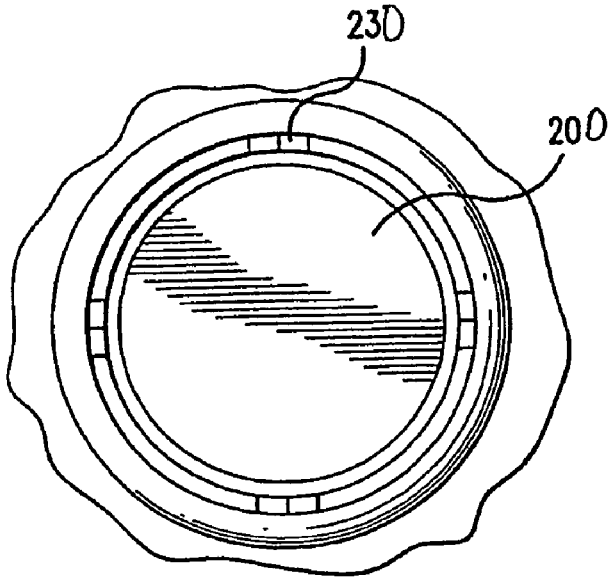
FIG. 7 is a plan view of the container neck of FIG. 6.
Figure 5:
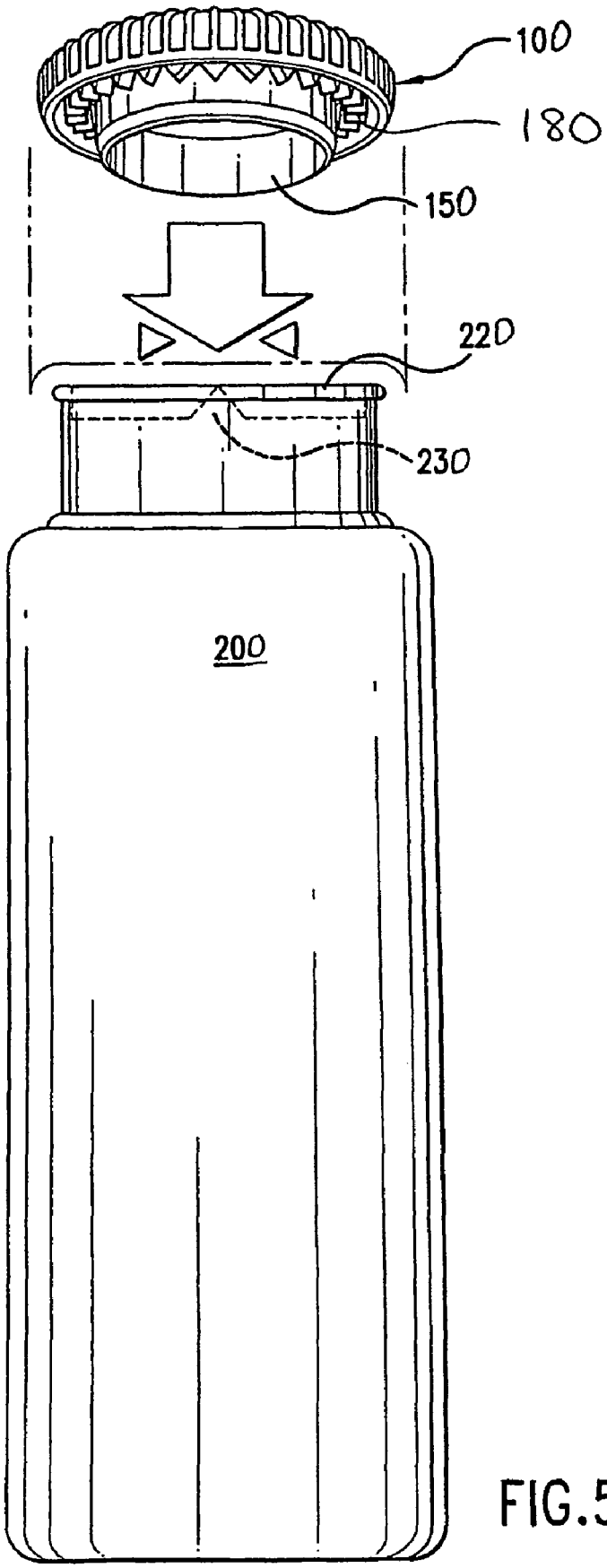
FIG. 5 is an exploded, front elevational view of the closure cap and container of FIG. 1 during assembly of the cap onto the container.

Returning now to FIGS. 1–8B, the inner sealing area 115 or bottom side of the cap 100 generally comprises a plug seal 150 having a tapered bottom edge 155 (FIG. 2) that is configured to sealingly fit into the container 200 as shown for example in FIG. 1 as an outer wall 160 of the plug seal abuts an inner wall 210 of the container 200. Circumferentially located around the inner sealing area 115 is a plurality of downwardly-extending engaging members or teeth 180, which are generally formed as oppositely-sloped edges 182, 184 joined at a point of inflection 183, which point of inflection may be sharp 183 (FIG. 8A) or rounded 183*a* (as defined between edges 182*a* and 184*a* of teeth 180*a* of cap 100*a* of FIG. 8B). Container 200, which is typically injection blown, has at least one, and preferably a plurality (such as four as shown in FIG. 6) of upwardly projecting engaging members or teeth 230 (FIG. 8A, or teeth 230*a* in the embodiment in FIG. 8B), which mate with teeth 180 (or teeth 180*a* in the embodiment of FIG. 8B) on the underside 115 of the cap 100, as described further herein. Container teeth 230 may be provided as single teeth as shown in FIG. 6, or in pairs as shown in FIG. 13, or as a continuous row of teeth (not shown) complementary to the continuous row of teeth 180 provided on the cap 100.

To secure the cap 100 back onto the container 200 once the tamper-evident ring 300 has been separated from the side skirt 120, the plug seal 150 is brought downwardly into the container 200 so that the outer wall 160 of the plug seal 150 abuts the inner wall 210 of the container 200 and is further secured by additional sufficient downward pressure on the outer pressing surface 110 of the cap 100 so that the underside annular opening 170 of the outer ring 120 of the cap 100 surrounds and locks into place the upper bead or lip 220 of the container 200. This downward pressure also aligns the registration of the upwardly-extending teeth 230 on the container 200 into the corresponding teeth 180 on the cap 100, such that the mating teeth 180 and 230 become self-aligning with respect to each other. Thus, the cap 100 is held secure by both the teeth registration and by the locking of the annular ring 170 with the lip or upper bead 220 of the container 200. Of course, this assembly process applies equally for the initial assembly of the cap 100 having the tamper-evident ring 300 attached thereto, although FIGS. 1–8 illustrate the cap 100 without the ring 300 attached thereto and with a container 200 that does not have the lower bead 225 as shown in FIGS. 9–14, for purposes of illustrating the attachment of the cap 100 to the container 200 after the tamper-evident ring 300 has been separated from the cap 100.

Figure 8A:
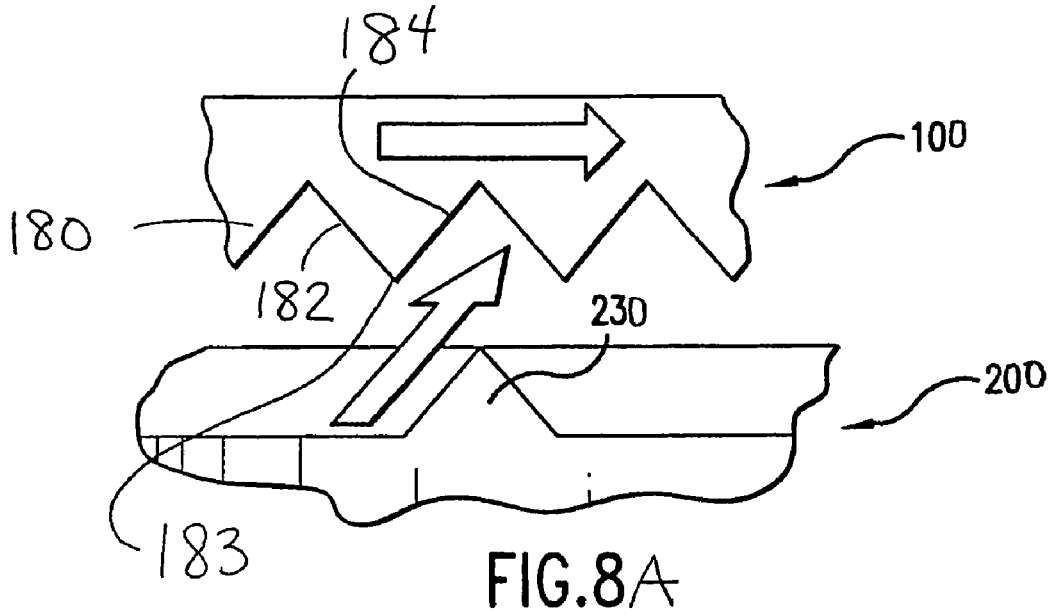
FIG. 8A is a schematic view of the interaction between the teeth of the closure cap and container during the opening/removal process.
Figure 8B:
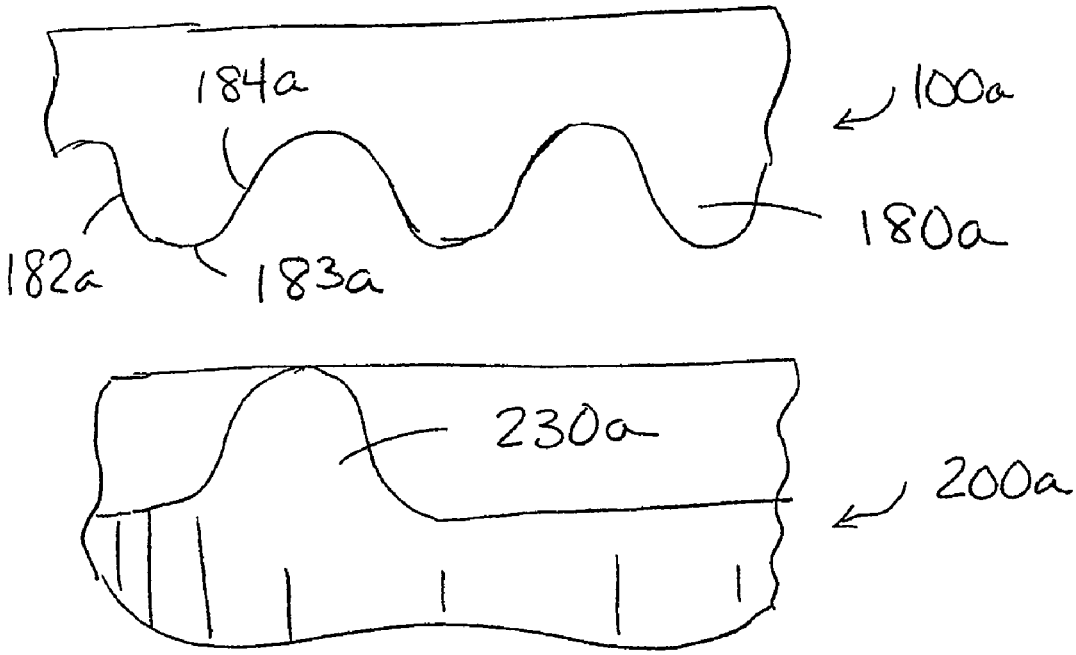
FIG. 8B is a schematic view of an alternative interaction between teeth of the closure cap and container during the opening/removal process.

To remove the closure 100 from the container 200, the top 110 may be twisted by the consumer in either the clockwise or counterclockwise direction. The twisting of the cap 100 causes the teeth 180 (or 180*a* in the embodiment of FIG. 8B) to function as cam surfaces relative to the teeth 230 (or 230*a* in the embodiment of FIG. 8B), such that the teeth 180, 180*a* are forced upwardly over the lower teeth 230, 230*a*. In other words, in the embodiment of FIG. 8A, surface 184 is forced upwards in response to a counterclockwise rotation of the cap 100 as shown, while in the embodiment of FIG. 8B, surface 184*a* is forced upwardly over lower tooth 230*a* in response to a counterclockwise rotation of the cap 100*a*. FIGS. 8A and 8B illustrate identical functional processes, the only difference being the structural configuration of the teeth. Of course, the movement arrows illustrated in FIG. 8A are not meant to be viewed in a limiting sense, but can be reversed if the cap 100 is rotated in the opposite direction relative to the container 200. Movement of the cap 100 upwardly relative to the container 200 causes the outer bead or lip 220 of the container 200 to push downwardly on the underside 170 of the outer ring 120, causing it to spread or move outwardly until the cap 100 is released from the container 200.

Figure 14:
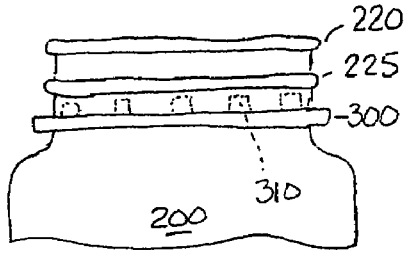
FIG. 14 is a partial side elevational view of a separated tamper-evident ring positioned on the container of FIG. 9.

If the tamper-evident ring 300 is attached to the side skirt 120 during the initial removal of the cap 100 from the container 200, then the removal operation described above also results in the separation of the ring 300 from the side skirt 120 and the resultant positioning of the ring 300 on the container neck as shown in FIG. 14. If the tamper-evident ring 300 has already been separated from the side skirt 120, and the re-attached cap 100 is being removed from the container 200 from a second or subsequent time, then the removal operation described above merely results in the complete removal of the cap 100 from the container 200.

The closure of the present invention provides a lower manufacturing because of a simplified and faster assembly process. The initial assembly requires a straight downward force on the cap 100 and side skirt 120 to engage the teeth 180, 230 and snap the cap 100 and ring 300 assembly over the container's upper and lower beads 220, 225. The angles provided on both sides of the engaging and disengaging teeth 180, 230 that are located around the top inside skirt of the cap 100 enable the cap 100 to be automatically self centering left or right when the cap 100 is assembled to the top of the container 200. The closure does not require threading or turning to secure it onto the container and has thus simplified the assembly machinery and process along with reducing assembly time.

Furthermore, because the cap design eliminates typical threads found on most containers and interior cap side walls, the cap can be pushed directly down onto the container, which eliminates the time and assembly equipment associated with threaded caps. In addition, this design provides a consumer with a fast, efficient and easy way to remove the cap 100 without unthreading, squeezing or pulling. When the consumer twist's the cap 100 left or right, the teeth 180, 230 become small cams and eject the cap 100 from the container 200, causing the upper bead 220 to unsnap and the cap 100 to open. The cap 100 is simple and easy to open but still requires a deliberate left or right turning action, which virtually eliminates the possibility of an accidental opening.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

We claim:

1. A closure for a container, comprising:

a) a top having an outer pressing surface and an inner sealing area, b) a side skirt extending downwardly from said outer pressing surface, c) a tamper-evident ring attached to said side skirt and detachable therefrom when said closure is first removed from said container, d) a circumferential plug seal provided on said inner sealing area and adapted to sealingly engage an inner wall surface of a neck of the container, and e) a plurality of downwardly extending engaging members provided on said inner sealing area spaced radially inward and apart from the side skirt and spaced radially outward and apart from the plug seal and having camming surfaces formed by oppositely-sloped edges and adapted to engage corresponding camming surfaces of at least one upwardly-extending tooth provided on the inner wall surface of the neck of said container and align said closure relative to said container neck during attachment of said closure to said container, f) wherein after said tamper-evident ring has been detached from said side skirt, said closure is sealingly attachable to said container solely by pressing downwardly on said outer pressing surface and is removable from said container by rotating said closure in either the clockwise or counterclockwise directions and lifting said closure from said container.

2. A closure in accordance with claim 1, wherein prior to detachment from said side skirt, said tamper-evident ring is spaced from said side skirt by a plurality of posts.

3. A closure in accordance with claim 2, wherein said plurality of posts taper outwardly toward said side skirt.

4. A closure in accordance with claim 3, wherein said plurality of posts further comprise weakened portions located adjacent said tamper-evident ring.

5. A closure in accordance with claim 1, wherein said plurality of downwardly-extending engaging members further comprise a plurality of teeth circumferentially positioned around said inner sealing area, each tooth further comprising oppositely-sloped edges joined at a point of inflection.

6. A closure in accordance with claim 5, wherein said point of inflection is sharp.

7. A closure in accordance with claim 5, wherein said point of inflection is rounded.

8. A closure in accordance with claim 1, wherein a pair of adjacently-positioned downwardly-extending engaging members is adapted to engage an upwardly-extending engaging member provided on said container such that said upwardly-extending engaging member is seated between said pair of adjacently-positioned downwardly-extending engaging members during attachment of said closure to said container.

9. A closure in accordance with claim 8, wherein said downwardly-extending and upwardly-extending engaging members are provided with complimentary cam surfaces such that rotation of said closure relative to container causes at least one downwardly-extending engaging member of said pair to ride up said upwardly-extending engaging member, resulting in the lifting of said closure from said container.

10. A closure in accordance with claim 9, wherein said plurality of downwardly-extending engaging members is adapted to engage a plurality of upwardly-extending engaging member provided on said container.

11. A closure in accordance with claim 1, further comprising gripping ridges provided on said side skirt.

12. A closure in accordance with claim 11, further comprising gripping ridges provided on said outer pressing surface.

13. A closure in accordance with claim 1, further comprising a circumferential plug seal provided on said inner sealing area and adapted to engage an inner wall of said container.

14. An assembly of a cap and a container, comprising:

a) a container having a neck formed from a single piece of material and with an inner wall surface and an outer wall surface and at least one upwardly-extending tooth having camming surfaces formed by oppositely-sloped edges joined at a point and formed integrally on the inner wall surface of the neck, b) a cap comprising:

i. a top with an outer pressing surface and an inner sealing area, ii. a side skirt extending downwardly from said outer pressing surface and adapted to engage said outer wall surface of said container neck, iii. a tamper-evident ring attached to said side skirt and detachable therefrom when said cap is first removed from said container, iv. a circumferential plug seal provided on said inner sealing area and adapted to engage said inner wall surface of said container, the plug seal being sized and shaped to sealingly engage the inner surface of the container neck, and v. a plurality of downwardly extending teeth circumferentially arranged around said inner sealing area spaced radially inward and apart from said side skirt and spaced radially outward and apart from the plug seal and provided on the ton interior surface and having camming surfaces formed by oppositely-sloped edges and adapted to engage the camming surfaces of said at least one upwardly-extending tooth provided on said container for aligning said cap relative to said container during attachment of said cap to said container, c) wherein after said tamper-evident ring has been detached from said side skirt, said closure is sealingly attachable to said container solely by pressing downwardly on said outer pressing surface and is removable from said container by rotating said closure in either the clockwise or counterclockwise directions to bring said downwardly extending tooth camming surfaces into operative engagement with said upwardly extending tooth camming surfaces to lift said closure from said container.

15. An assembly in accordance with claim 14, wherein prior to detachment from said side skirt, said tamper-evident ring is spaced from said side skirt by a plurality of posts.

16. An assembly in accordance with claim 15, wherein said plurality of posts taper outwardly toward said side skirt and further comprise weakened portions located adjacent said tamper-evident ring.

17. An assembly in accordance with claim 14, wherein each tooth of said upwardly-extending and downwardly-extending engaging teeth further comprise oppositely-sloped edges joined at a point of inflection.

18. An assembly in accordance with claim 17, wherein said point of inflection is sharp.

19. An assembly in accordance with claim 17, wherein said point of inflection is rounded.

20. An assembly in accordance with claim 14, wherein said container further comprises a plurality of upwardly-extending teeth adapted to engage said plurality of downwardly-extending teeth provided on said cap.

21. An assembly in accordance with claim 14, further comprising gripping ridges provided on said side skirt.

22. An assembly in accordance with claim 14, further comprising gripping ridges provided on said outer pressing surface.

23. An assembly of a cap and a container, comprising:

a container including:

a neck formed from a single piece of material and having an inner wall having first and second inner surfaces, the first and second inner surfaces defining different diameters of the neck, and an outer wall surface, at least one upwardly-extending tooth having camming surfaces formed by oppositely-sloped edges joined at a point of inflection and formed integrally on the inner wall adjacent to the first inner surface of the neck, and a cap including:

a top with an exterior surface and an interior surface, a side skirt extending downwardly from an outer periphery of the top and adapted to engage said outer wall of said container neck, a tamper-evident ring attached to said side skirt and detachable therefrom when said cap is first removed from said container, a circumferential plug seal formed by a circumferential wall directly connected to the interior surface of the top, the seal forming a hollow cylinder extending downwardly from the top interior surface, the plug seal being sized and shaped to sealingly engage the second inner surface of the container neck, and a plurality of downwardly extending teeth spaced radially inward and apart from said side skirt and spaced radially outward and apart from the plug seal and directly connected to the top interior surface and circumferentially arranged near the periphery of the top and having camming surfaces formed by oppositely-sloped edges joined at a point of inflection and adapted to engage the camming surfaces of said at least one upwardly-extending tooth provided on said inner wall of said container neck, wherein said closure is sealingly attachable to said container by pressing downwardly on said exterior surface and is removable from said container by rotating said closure relative to the container in either the clockwise or counterclockwise directions to bring said downwardly extending tooth camming surfaces into operative engagement with said upwardly extending tooth camming surfaces to lift said closure from said container.

24. An assembly in accordance with claim 23, wherein said inner wall of said container neck further comprises a plurality of upwardly-extending teeth adapted to engage said plurality of downwardly-extending teeth provided on said cap.

25. An assembly in accordance with claim 23, further comprising gripping ridges provided on said side skirt.

26. An assembly in accordance with claim 23, further comprising gripping ridges provided on said exterior surface.

* * * * *